US007152807B2

(12) United States Patent
Nevins

(10) Patent No.: US 7,152,807 B2
(45) Date of Patent: Dec. 26, 2006

(54) PRE-FASTENED RAIL PAD ASSEMBLY AND METHOD

(76) Inventor: James H. Nevins, 1538 Lake Crest Dr., Roaming Shores, OH (US) 44084

( * ) Notice: Subject to any disclaimer, the term of this patent is extended or adjusted under 35 U.S.C. 154(b) by 66 days.

(21) Appl. No.: 10/924,517

(22) Filed: Aug. 24, 2004

(65) Prior Publication Data

US 2006/0043205 A1 Mar. 2, 2006

(51) Int. Cl.
*E01B 9/00* (2006.01)

(52) U.S. Cl. ..... 238/283; 238/382

(58) Field of Classification Search ..... 238/283, 238/382, 107, 264, 287
See application file for complete search history.

(56) References Cited

U.S. PATENT DOCUMENTS 4,757,945 A * 7/1988 Leeves ..... 238/107
2004/0113133 A1 6/2004 Geissele et al.

FOREIGN PATENT DOCUMENTS

GB 2 237 314 * 10/1989

* cited by examiner

*Primary Examiner*—Mark T. Le
(74) *Attorney, Agent, or Firm*—Pearne & Gordon LLP

(57) ABSTRACT

A rail pad assembly and an associated method for use with a concrete rail tie. The rail pad assembly includes a rail pad for engagement with a metal rail, a protective sheet for engagement with a concrete rail tie, and means for attaching the rail pad to the sheet integrally formed in at least one of the rail pad and the protective sheet. In one specific example, the protective sheet is made from ultrahigh molecular weight polyethylene.

4 Claims, 3 Drawing Sheets

PRE-FASTENED RAIL PAD ASSEMBLY AND METHOD

FIELD OF THE INVENTION

The present invention relates to the field of rail pad assemblies for railway systems that have metal rails and concrete rail ties.

BACKGROUND OF THE INVENTION

Railway systems commonly seat a metal rail upon a concrete rail tie via the use of a rail pad. There is a well-known problem of abrasion that can occur between a rail pad and a concrete rail tie.

Generally, a rail pad deflects vertically and horizontally in a cyclic fashion under the loads imposed by the wheels of passing trains. The cyclical loads imposed upon the rail pad create relatively short-term vertical load pulses that cause the face of the rail pad to oscillate on the concrete tie. Deterioration of the rail pad and erosion of the concrete rail tie can occur. It is known to use a protective member or sheet located between the rail pad and the concrete rail tie to prevent deterioration. The rail pad and the protective sheet can be considered to be the major parts of a rail pad assembly. However, the handling of the various components of a rail pad assembly is often labor intensive and/or otherwise problematic.

SUMMARY OF THE INVENTION

In accordance with one aspect, the present invention provides a rail pad assembly for use with a concrete rail tie. The rail pad assembly includes a rail pad for engagement with a metal rail, a protective sheet for engagement with a concrete rail tie, and means for attaching the rail pad to the sheet integrally formed in at least one of the rail pad and the protective sheet.

In accordance with another aspect, the present invention provides a rail pad assembly for use with a concrete rail tie that includes an elastomeric rail pad for engagement with a metal rail, a protective sheet for engagement with a concrete rail tie, wherein the protective sheet is made from ultrahigh molecular weight polyethylene, and means for attaching the rail pad to the sheet integrally formed in at least one of the rail pad and the protective sheet.

In accordance with another aspect, the present invention provides a method of assembling a rail pad assembly for use with a concrete rail tie. The method includes the steps of: (1) providing a rail pad for engagement with a metal rail; (2) providing a protective sheet for engagement with a concrete rail tie; (3) providing means for attaching the rail pad to the sheet integrally formed in at least one of the rail pad and the sheet; and (4) attaching the rail pad to the sheet using the means for attaching.

BRIEF DESCRIPTION OF THE DRAWINGS

The foregoing and other features and advantages of the present invention will become apparent to those skilled in the art to which the present invention relates upon reading the following description with reference to the accompanying drawings wherein.

DESCRIPTION OF EXAMPLE EMBODIMENTS

Figure 1:
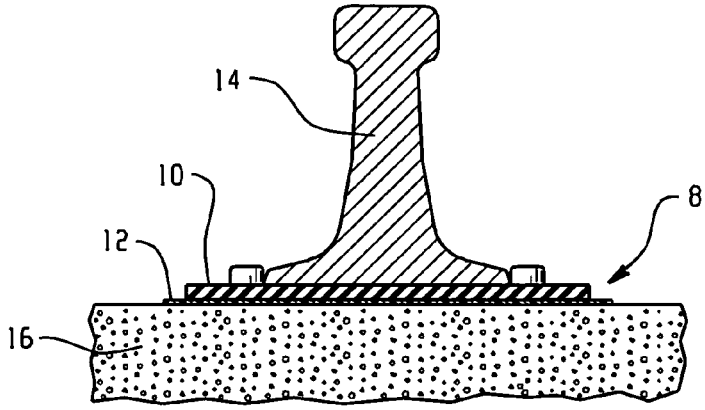
FIG. 1 is a section view of an example rail pad assembly, which has a rail pad and a protective sheet, between a metal rail and a concrete rail tie.

Referring initially to FIG. 1 of the drawings, a rail pad assembly 8 is shown for use with a metal rail 14 and a concrete rail tie 16. The rail pad assembly 8 includes a rail pad 10 and an attached protective sheet 12. It is to be appreciated that the attached aspect provides a pre-fastened assembly that provides for ease of handling, etc. during transport, installation, etc. As shown in an example embodiment in FIG. 1, the metal rail 14 sits atop the rail pad 10, and the protective sheet 12 is located between the rail pad 10 and the concrete rail tie 16. The metal rail 14 is held in place by rail clamps (not shown) embedded in the concrete rail tie 16. Such rail clamps may take various forms, including various currently available forms, but are not limitations on the present invention.

Figure 2:
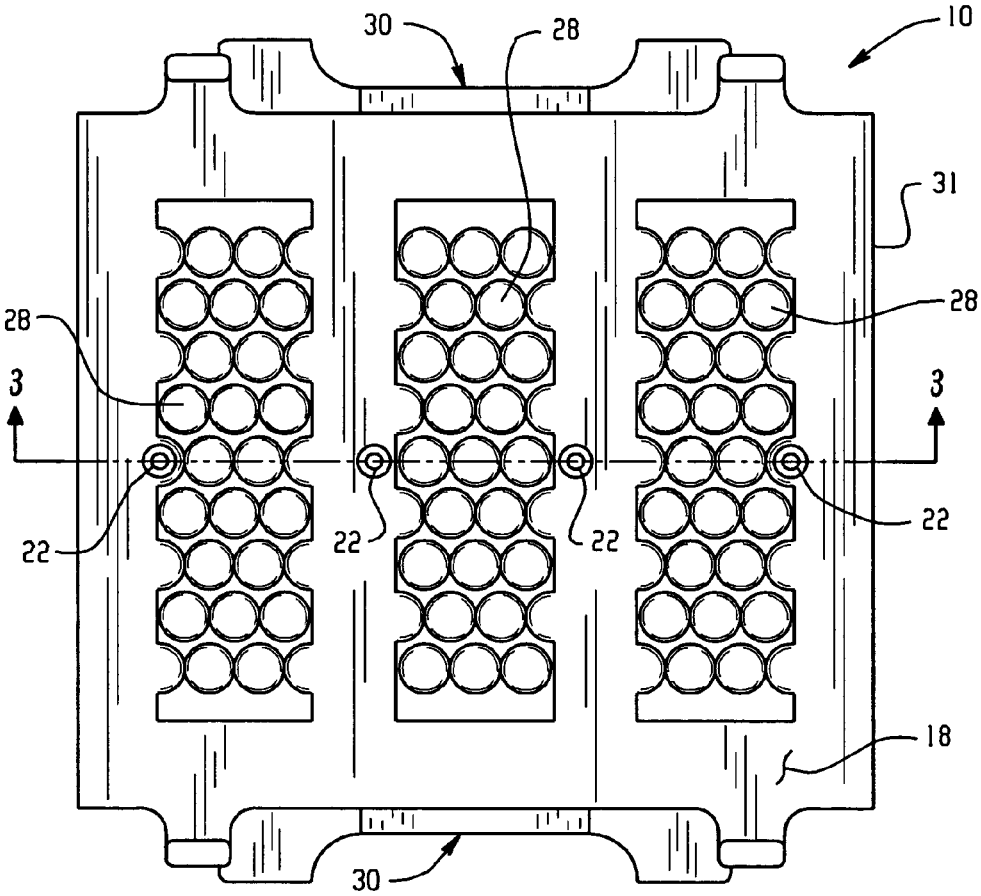
FIG. 2 is a top view of the rail pad of the assembly of FIG. 1.
Figure 3:
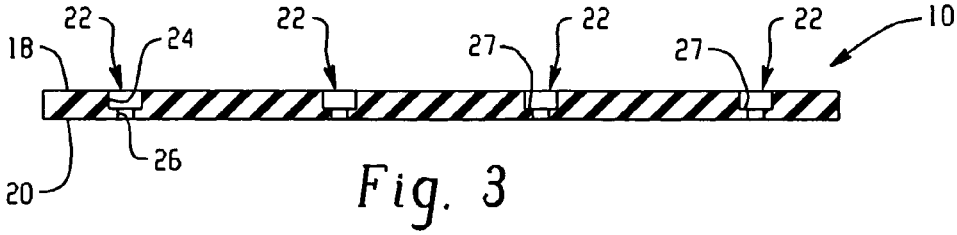
FIG. 3 is a sectional view of the rail pad taken along line 3—3 of FIG. 2.

Turning now to FIG. 2., the example rail pad 10 is shown in detail. In one example, the rail pad 10 is made of an elastomeric material, such as polyurethane or ethylene vinyl acetate (EVA). The rail pad 10 is generally rectangular or square, but it is to be appreciated that the rail pad 10 can be of any suitable shape. Turning briefly to FIG. 3, the rail pad 10 has a top surface 18 and a bottom surface 20. Turning back to FIG. 2, the top surface 18 of the rail pad 10 includes at least one rail-engaging area 28 having a tread pattern. In the example shown in FIG. 2, the top surface 18 includes three rail-engaging areas 28 having identical tread patterns. It is to be appreciated that the top surface 18 of the rail pad 10 may include any number of such areas 28, each having any tread pattern. Although the configuration of such features of the rail pad 10 is described for the purpose of comprehending the drawings, such configuration is not a limitation on the present invention.

As shown in the example of FIG. 2, the rail pad 10 has a generally square or rectangular outer periphery 31. The rail pad also includes various indentations and notches 30 along its outer periphery 31 for engagement with, and/or accommodation of, structure located along the railway system, such as the rail clamps (not shown). Such notches 30 are located between upwardly extending projections that are located on the sides of the rail 14 and seat the rail onto the rail pad 10. It is to be appreciated that the geometry of the rail pad 10 may be varied in any manner required by a particular railway system, and such features are not limitations on the present invention.

In the example shown in FIG. 2, the rail pad 10 also includes at least one passageway 22 extending therein as part of a configuration for attaching the rail pad 10 to the protective sheet 12. It is to be appreciated that the rail pad 10 may include any number of passageways 22 that may or may not extend completely through the rail pad 10. In the example shown in FIG. 3, the passageways 22 comprise four holes extending from the top surface 18 of the rail pad to the bottom surface 20. Each passageway 22 is countersunk within the rail pad 10 such that the upper portion 24 of each passageway 22 has a diameter greater than the lower portion 26 of each passageway 22. The difference in diameter between the upper portion 24 and the lower portion 26 of each passageway 22 creates a circular shoulder 27 within each passageway 22 at the interface of the upper portion 24 and the lower portion 26. It is to be appreciated that the passageways 22 may be of any size, shape, number, geometry, and position.

Figure 4:
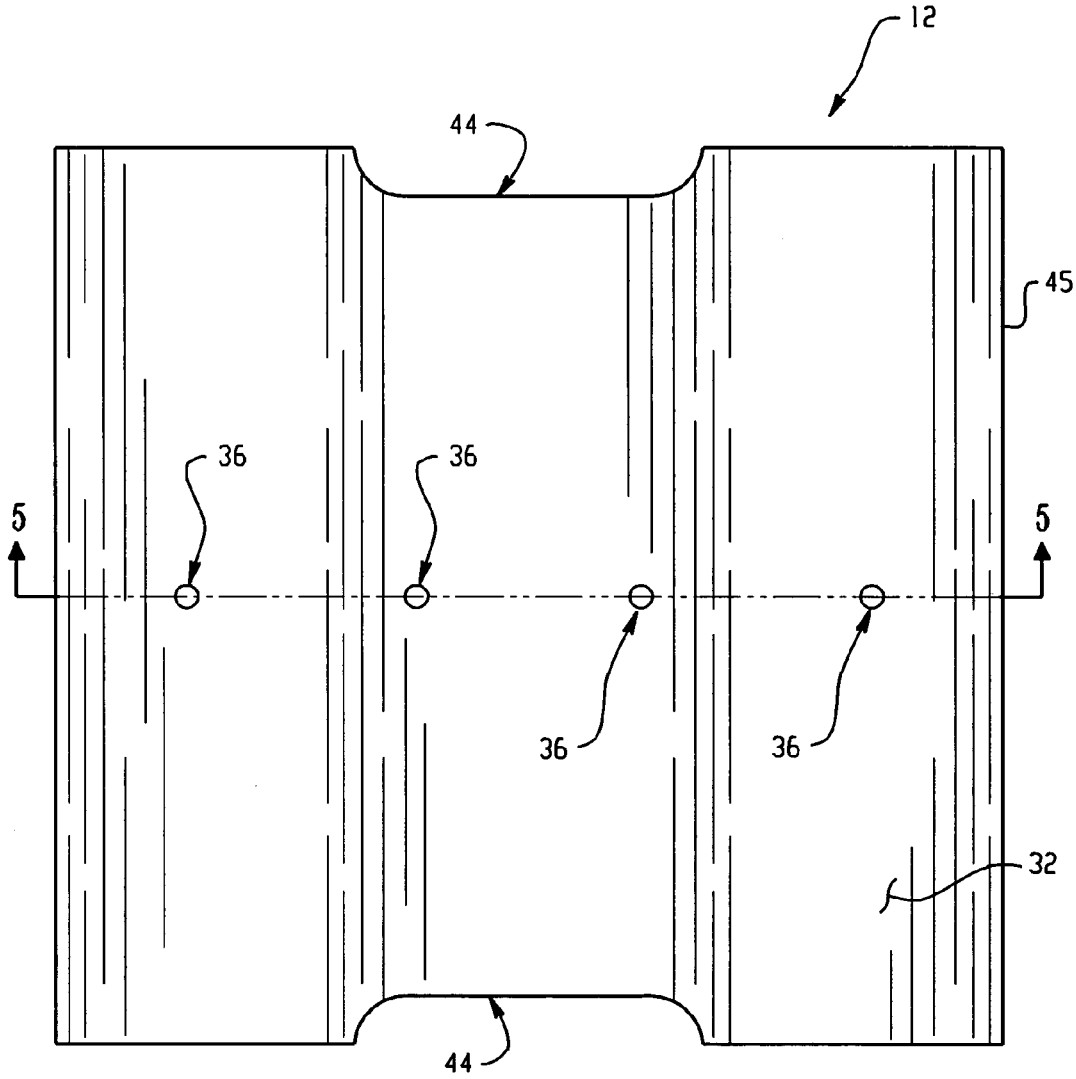
FIG. 4 is a top view of the protective sheet of the assembly of FIG. 1.

Turning now to FIG. 4, the example protective sheet 12 is shown in detail. In one example, the protective sheet 12 is made of tough and abrasion resistant material, such as ultrahigh molecular weight polyethylene (UHMWPE). One example of UHMWPE is a polyethylene (e.g., linear) with a molecular weight in the range of 3,000,000 to 6,000,000. Other more specific examples of UHMWPE may have molecular weight ranges bounded by the numbers 4,000,000 and/or 5,000,000. Although one aspect of the present invention includes the use of UHMWPE, it is to be appreciated that other materials that offer beneficial characteristics, such as abrasion resistance and/or impact strength, may be used for the protective sheet 12 in accordance with other aspects of the present invention. It is to be appreciated that the protective sheet 12, with the structures described herein, may be made by any process including, but not limited to a process that includes injection forming, compression forming, or injection and compression forming.

Figure 5:
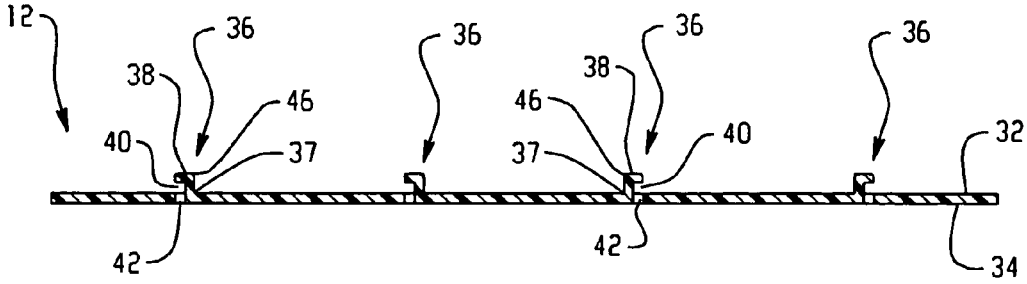
FIG. 5 is a sectional view of the protective sheet taken along line 5—5 of FIG. 4.
Figure 6:
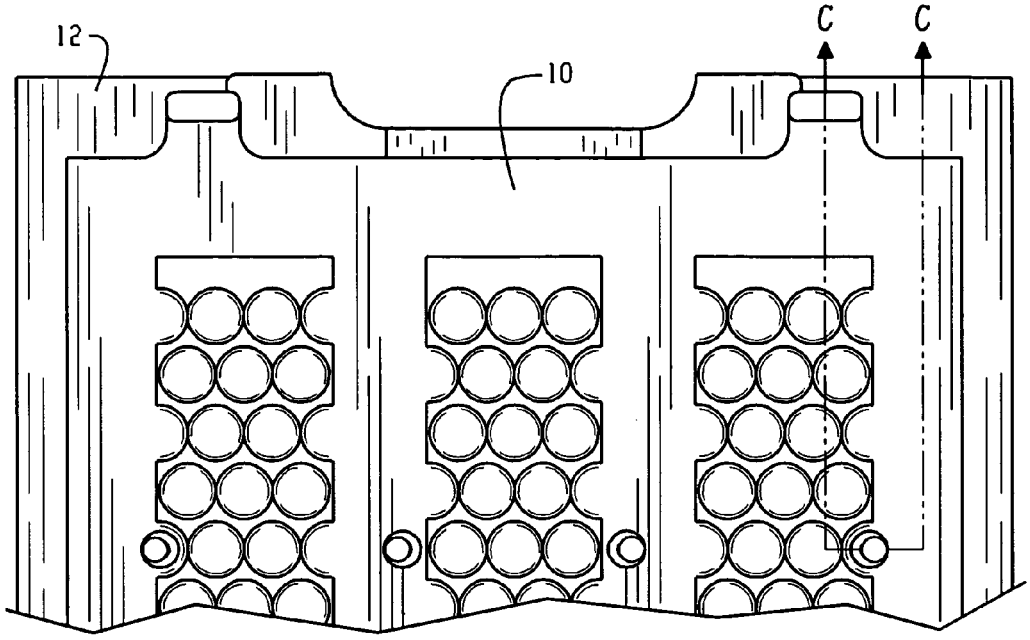
FIG. 6 is an enlarged, plan view of a portion of the assembly of FIG. 1.

Turning briefly to FIG. 5, the protective sheet 12 has a top major surface 32 and a bottom major surface 34. The top surface 32 and the bottom surface 34 of the protective sheet 12 are substantially flat. However, it is to be appreciated that the contours of the top surface 32 and/or the bottom surface 34 are not limitations on the present invention. As shown in FIG. 6, the outer periphery shape of the protective sheet 12 is generally similar to the outer periphery shape of the rail pad 10. That is to say that the shown example of the protective sheet 12 has a generally rectangular or square shaped outer periphery, but it is to be appreciated that the protective sheet 12 can be of any suitable shape.

As shown in the example of FIG. 4, the protective sheet 12 also includes various indentations and notches 44 along its outer periphery 45 for engagement with, and/or accommodation of, structure located along the railway system, such as the rail clamps (mentioned above). It is to be appreciated that the outer geometry of the protective sheet 12 may be varied in any manner as required by a particular railway system, and is not a limitation on the present invention.

In the example shown in FIG. 4, the protective sheet 12 also includes at least one projection 36 extending from the top surface 32 to extend into a passageway 22, as means for attaching the protective sheet 12 to the rail pad 10. It is to be appreciated that the protective sheet 12 may include any number of projections that extend into corresponding passageways 22. In the example shown in FIG. 5, four projections 36 are integrally formed as part of the protective sheet 12 and extend from the top surface 32 thereof. The projections 36 have a first end 37 attached at the top surface 32 of the protective sheet 12 and a second end 38 located at a distance from the top surface 32. The second end 38 has a relatively larger cross-sectional area due to a cutout portion 40, which adjacent to the first end 37, and located between the top surface 32 and the second end 38 of the projection 36. In the example shown in FIG. 5, the cutout portions 40 of the two projections 36 located on the left half of the protective sheet 12 face a direction opposite the cutout portions 40 of the two projections 36 located on the right half of the protective sheet 12. Additionally, the second end 38 of each projection may include a chamfered edge 46 to facilitate ingress of the projection 36 into a mating passageway. However, it is to be appreciated that the projections 36, including the cutout portions 40, may be of any size, shape, number, geometry and position. Furthermore, a passageway 42 may be positioned adjacent to the projection 36 and may extend though the protective sheet 12. This passageway 42 may facilitate formation.

Turning now to FIG. 6, the rail pad 10 is shown attached to the protective sheet 12 to form the rail pad assembly 8. The various indentations and notches 30 along the outer periphery 31 of the rail pad 10 are generally aligned with the various indentations and notches 44 along the outer periphery 45 of the protective sheet 12. In the example shown in FIG. 6, the longitudinal dimension of the protective sheet 12 is greater than the longitudinal dimension of the rail pad 10. However, it is to be appreciated that the dimensions of the rail pad 10 and the protective sheet 12 may be varied in any manner as required by a particular railway system.

Figure 7A:
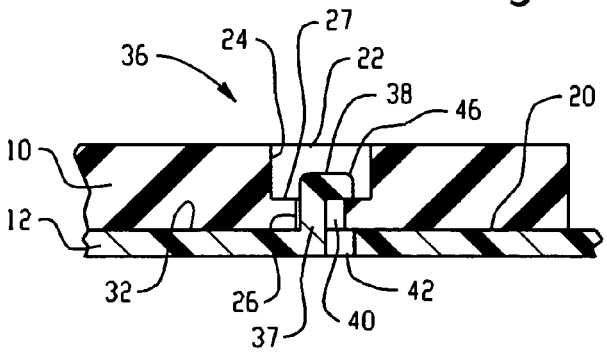
FIG. 7*a* is an enlarged, sectional view of the rail pad assembly taken along line 7*a*—7*a* of FIG. 6.

In the example shown in FIG. 7*a*, each passageway 22 of the rail pad 10 receives a respective projection 36 of the protective sheet 12 for a snap-fit interconnection. The projection 36 is inserted through the lower portion 26 of the passageway 22 and into the upper portion 24 of the passageway 22 until the bottom surface 20 of the rail pad 10 engages the top surface 32 of the protective sheet 12. The snap-fit interconnection is created by an interaction between the cutout portion 40 of the projection 36 and the circular shoulder 27 within the passageway 22 formed by the difference in diameter between the upper portion 24 and the lower portion 26 thereof. The snap-fit interconnection ensures that the rail pad 10 remains attached to the protective sheet 12, and also allows for easy maintenance or replacement of the parts because the connection is reversible via application of a modest amount of separating force. It is to be appreciated that the drawing figures may show the dimensions of the projections 36 and the passageways 22 some what exaggerated to convey the concept. It is also to be appreciated that the interconnection may take various other forms. For example, the projections 36 and passageways 22 may provide for a friction or interference fit. In fact, the shown example, is to be understood to be one type of interference fit.

Figure 7B:
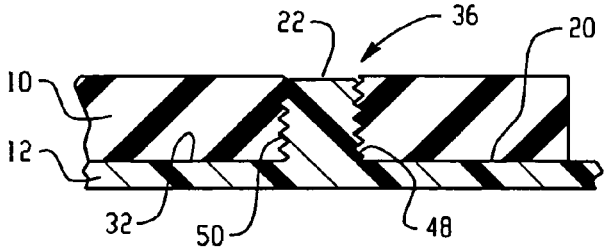
FIG. 7*b* is a view similar to FIG. 7*a*, but shows an alternate construction that includes a ridged, ringed, or threaded connection.

In another example of the rail pad assembly 8 shown in FIG. 7*b*, at least one projection 36 may be ridged, ringed, or threaded and at least one passageway 22 may be adapted to receive the ridged, ringed, or threaded projection 36. In this example, the projection 36 includes ridges, rings, or threads 50 that engage with ridges, rings, or threads 48 disposed on the interior surface of the passageway 22 to form a retaining connection.

Figure 7C:
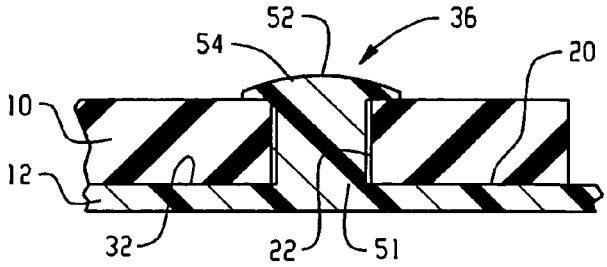
FIG. 7*c* is a view similar to FIG. 7*a*, but shows another alternate construction that includes a rivet connection.

In yet another example of the rail pad assembly 8 shown in FIG. 7*c*, at least one projection 36 may comprise a rivet-like structure 54 and at least one passageway 22 may be adapted to receive the rivet-like structure. In this example, the projection includes a first end 51 and a second end 52 extending a distance from the first end 51, wherein the diameter of the second end 52 is greater than the diameter of the first end 51 to form a rivet-like structure 54. The diameter of the second end 52 is also greater than the diameter of the passageway 22. A rivet-like interconnection is created by inserting the second end 52 of the projection 36 through the passageway 22 until the bottom surface 20 of the rail pad 10 mattingly engages the top surface 32 of the protective sheet 12. The top of the rivet-like structure may deflect during insertion. Of course, it is to be appreciated that dimensions may be exaggerated to show the concept.

It is to be appreciated that any projection 36 may be adapted to any passageway 22 to ensure that the rail pad 10 is attached to the protective sheet 12 to make handling, etc. easier. Accordingly, it is also to be appreciated that the rail pad 10 may include any number of projections, and the protective sheet 12 may include any number of passageways, in a fashion similar to that disclosed herein. Of course, it is to be appreciated that the projections and the passageways may be reversed between the rail pad 10 and the protective sheet 12 (i.e., projections extending from the rail pad). Also, other types of integrally-formed, attaching/retaining elements on the pad and sheet are contemplated to be within the scope of the present invention. As such, it is to be appreciated that the present invention provides means to attach the rail pad 10 and the protective sheet 12, which does not require separate attachment components, devices, etc. For example, pieces of adhesive tape extending to secure the protective sheet to the rail pad and are not needed.

The present invention also includes a method of assembling a rail pad assembly 8 for use with a concrete rail tie 16. First, a rail pad 10 is provided for engagement with a metal rail 14. Next, a protective sheet 12 is provided for engagement with a concrete rail tie 16. Next, means for attaching the rail pad 10 to the protective sheet 12 are provided. The means for attaching are integrally formed in at least one of the rail pad 10 and the protective sheet 12. Finally, the rail pad 10 is attached to the protective sheet 12 using the means for attaching. It is to be appreciated that the steps of this example method may be performed in any order, and that additional steps may be incorporated into this example method as required.

It is to be understood that the invention has been described with regard to certain example embodiments. It is to be appreciated that certain modifications, changes, adaptations, etc., are contemplated and considered within the scope of the appended claims.

What is claimed:

1. A rail pad assembly for use with a concrete rail tie, comprising:

a rail pad for engagement with a metal rail;

a protective sheet for engagement with a concrete rail tie; and means for releasably attaching the rail pad to the sheet integrally formed in at least one of the rail pad and the protective sheet and releasing attachment without destruction;

wherein the means for attaching comprises at least one projection on at least one of the rail pad and the protective sheet, at least one passageway extending in at least one of the rail pad and the protective sheet, the projection and the passageway having an interference fit relationship, the projection includes a first, attached end and a second, distal end, with a relatively increased cross-sectional area at the second end, and the relatively increased cross-sectional area of the projection is provided via a cutout portion, a passageway is positioned adjacent to the projection and extends through the rail pad or the protective sheet on which the projection is formed.

2. A rail pad assembly for use with a concrete rail tie, comprising;

an elastomeric rail pad for engagement with a metal rail;

a protective sheet for engagement with a concrete rail tie, wherein the protective sheet is made from ultrahigh molecular weight polyethylene; and means for releasably attaching the rail pad to the sheet integrally formed in at least one of the rail pad and the protective sheet and releasing attachment without destruction;

wherein the means forr attaching comprises at least one projection on at least one of the rail pad and the protective sheet, and at least one passageway extending in at least one of the rail pad and the protective sheet, the projection and the passageway having an interference fit relationship, and the projection includes a first, attached end and a second, distal end, with a relatively increased cross-sectional area at the second end, and wherein the relatively increased cross-sectional area of the projection is provided via a cutout portion, a passageway is positioned adjacent to the projection and extends through the rail pad or the protective sheet on which the projection is formed.

3. A method of assembling a rail pad assembly for use with a concrete rail tie, comprising the steps of:

providing a rail pad for engagement with a metal rail;

providing a protective sheet for engagement with a concrete rail tie;

providing means for attaching the rail pad to the sheet intearally formed in at least one of the rail pad and the sheet prior to attaching the rail pad to the sheet; and attaching the rail pad to the sheet using the means for attaching, wherein the means for attaching comprises at least one projection on at least one of the rail pad and the sheet, and at least one passageway extending through at least one of the rail pad and the sheet, the projection and the passageway having an interference fit relationship, the projection includes a relatively increased cross-sectional area at a distal end, and the increased cross-sectional area of the projection is formed from a cutout portion at the distal end, a passageway is positioned adjacent to the projection and extends through the rail pad or the protective sheet on which the projection is formed.

4. A rail pad assembly for use with a concrete rail tie, comprising:

a rail pad for engagement with a metal rail;

a protective sheet for engagement with a concrete rail tie; and means for releasably attaching the rail pad to the sheet integrally formed in at least one of the rail pad and the protective sheet and releasing attachment without destruction;

wherein the means for attaching comprises four projections on the sheet and four passageways extending through the rail pad, wherein the projections each include includes a first, attached end and a second, distal end, each projection having a relatively increased cross-sectional area at the second end, and wherein the passageways comprise holes adapted to receive the projections for a snap-fit interconnection and each of the four projections has a cutout portion, two of the projections have the cutout facing in a first direction and the other two of the projections have the cutout facing in a second direction, which is opposite to the first direction.

* * * * *